US008872606B1

(12) United States Patent
Maloney et al.

(10) Patent No.: US 8,872,606 B1
(45) Date of Patent: Oct. 28, 2014

(54) BIMETAL AND MAGNETIC ARMATURE PROVIDING AN ARC SPLATTER RESISTANT OFFSET THEREBETWEEN, AND CIRCUIT BREAKER INCLUDING THE SAME

(71) Applicant: Eaton Corporation, Cleveland, OH (US)

(72) Inventors: James Gerard Maloney, Industry, PA (US); Edward Ethber Lias, Aliquippa, PA (US); Jeffrey Scott Gibson, Hookstown, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 13/868,411

(22) Filed: Apr. 23, 2013

(51) Int. Cl.

| | |
|---|---|
| ***H01H 75/08*** | (2006.01) |
| ***H01H 77/04*** | (2006.01) |
| ***H01H 81/02*** | (2006.01) |
| ***H01H 71/50*** | (2006.01) |
| ***H01H 71/40*** | (2006.01) |

(52) U.S. Cl.
CPC ..... *H01H 71/504* (2013.01); *H01H 71/405* (2013.01); *H01H 71/40* (2013.01)
USPC ..... 335/43; 335/145; 335/38

(58) Field of Classification Search
CPC ..... H01H 71/40; H01H 71/16; H01H 71/48; H01H 83/20; H01H 37/52; H01H 71/405; H01H 71/505; H02H 3/08
USPC ..... 335/2, 6, 18, 21, 38, 43
See application file for complete search history.

(56) References Cited

U.S. PATENT DOCUMENTS

| | | | |
|---|---|---|---|
| 2,654,008 | A | 9/1953 | Toth et al. |
| 2,677,025 | A | 4/1954 | Dyer |
| 3,098,136 | A | 7/1963 | Stanback et al. |
| 3,110,786 | A | 11/1963 | Gelzheiser |
| 3,200,217 | A | 8/1965 | Bullis, Jr. |

(Continued)

FOREIGN PATENT DOCUMENTS

| | | |
|---|---|---|
| GB | 425748 | 3/1935 |
| GB | 718984 | 11/1954 |

(Continued)

OTHER PUBLICATIONS

European Patent Office, "International Search Report and Written Opinion", May 9, 2014, 13 pp.

*Primary Examiner* — Bernard Rojas
(74) *Attorney, Agent, or Firm* — Eckert Seamans Cherin & Mellott, LLC; Kirk D. Houser

(57) ABSTRACT

A trip mechanism includes a bimetal having a first side and an opposite second side, a magnetic yoke disposed proximate the first side of the bimetal, and a magnetic armature pivotally connected to the bimetal and disposed proximate the opposite second side thereof. The armature has a first side with a surface, an opposite second side, and an opening extending from the first side to the opposite second side of the magnetic armature. The opening has a latch surface structured to engage the latch surface of an operating mechanism. The first side of the magnetic armature is structured to engage the opposite second side of the bimetal. At least one of the bimetal and the magnetic armature is structured to provide an offset between the bimetal and the surface of the first side of the magnetic armature at the opening of the magnetic armature.

18 Claims, 4 Drawing Sheets

(56) References Cited

U.S. PATENT DOCUMENTS

| | | | | |
|---|---|---|---|---|
| 3,218,418 | A | 11/1965 | Dorfman et al. | |
| 3,550,047 | A | 12/1970 | Gelzheiser | |
| 3,581,261 | A | 5/1971 | De Torre et al. | |
| 4,081,852 | A | 3/1978 | Coley et al. | |
| 4,914,409 | A | 4/1990 | Cohen | |
| 5,130,684 | A | 7/1992 | Scott et al. | |
| 5,294,902 | A | 3/1994 | Pannenborg et al. | |
| 5,326,947 | A | 7/1994 | Edds et al. | |
| 5,381,121 | A | 1/1995 | Peter et al. | |
| 5,805,038 | A | 9/1998 | Palmer et al. | |
| 5,910,758 | A | 6/1999 | Maloney et al. | |
| 6,040,746 | A | 3/2000 | Maloney et al. | |
| 6,172,585 | B1 | 1/2001 | Zindler et al. | |
| 6,242,707 | B1 | 6/2001 | Mody et al. | |
| 6,249,197 | B1 | 6/2001 | Zindler et al. | |
| 6,259,341 | B1 | 7/2001 | Juds et al. | |
| 6,259,342 | B1 | 7/2001 | Malingowski et al. | |
| 6,759,931 | B1 * | 7/2004 | Lias et al. | 335/35 |
| 6,801,111 | B2 * | 10/2004 | Siebels et al. | 335/167 |
| 6,838,961 | B2 | 1/2005 | Lias et al. | |
| 6,879,228 | B2 * | 4/2005 | Lias et al. | 335/35 |
| 2011/0132875 | A1 | 6/2011 | Werner et al. | |

FOREIGN PATENT DOCUMENTS

| | | |
|---|---|---|
| GB | 1094229 | 12/1967 |
| GB | 1108494 | 4/1968 |
| GB | 1249508 | 10/1971 |
| GB | 1318760 | 5/1973 |
| GB | 1483914 | 8/1977 |
| GB | 1484359 | 9/1977 |
| GB | 1519230 | 7/1978 |
| GB | 1559228 | 1/1980 |
| KR | 101098226 | 12/2011 |

* cited by examiner

BIMETAL AND MAGNETIC ARMATURE PROVIDING AN ARC SPLATTER RESISTANT OFFSET THEREBETWEEN, AND CIRCUIT BREAKER INCLUDING THE SAME

BACKGROUND

1. Field

The disclosed concept pertains generally to circuit breaker trip mechanisms and, more particularly, to such trip mechanisms including a bimetal and a magnetic armature. The disclosed concept further pertains to circuit breakers including such trip mechanisms.

2. Background Information

Electrical switching apparatus, such as circuit interrupters, include an operating mechanism and a trip mechanism, such as a thermal trip assembly and/or a magnetic trip assembly. For example, the trip mechanism is automatically releasable to effect tripping operations and manually resettable following tripping operations.

Examples of circuit breakers including trip mechanisms are disclosed in U.S. Pat. Nos. 5,805,038 and 6,838,961, which are incorporated by reference herein. Such circuit breakers, commonly referred to as "miniature circuit breakers," have been in use for many years and their design has been refined to provide an effective, reliable circuit breaker which can be easily and economically manufactured and tested.

As is well known, circuit breakers of this type include, for example, at least one set of separable contacts disposed within a non-conductive housing. Typically, there is a fixed contact coupled to the housing and a movable contact coupled to the operating mechanism. The operating mechanism includes a movable handle that extends outside of the housing. Movement of the separable contacts is accomplished by the operating mechanism. The operating mechanism typically includes components such as the previously mentioned handle, an operating arm, upon which the movable contact is disposed, a cradle, and the trip mechanism, such as the previously mentioned thermal trip assembly and/or magnetic trip assembly. The cradle is coupled to a spring and disposed between the trip mechanism and the operating arm. The components may further include a frame to which the other components are coupled.

The circuit breaker is magnetically tripped automatically, and instantaneously, in response to overload currents above a predetermined value higher than another predetermined value for a thermal trip. Flow of overload current above the higher predetermined value through a bimetal induces magnetic flux around such bimetal. This flux is concentrated by a magnetic yoke toward an armature. An overload current above the higher predetermined value generates a magnetic force of such a strength that the armature is attracted toward the magnetic yoke resulting in the flexing of a spring permitting the armature to pivot, release the cradle and trip the circuit breaker open.

Typically, the circuit breaker includes the thermal trip assembly such as a bimetal assembly. When the circuit breaker is closed, a persistent overload current of a predetermined value causes the bimetal to become heated and deflect away from the cradle. The armature, which is supported on the bimetal by a leaf spring, is carried with the bimetal to release the cradle and trip the circuit breaker in a well known manner.

The armature includes an armature window having a latching surface that normally engages a corresponding latching surface of the cradle. During interruption, when the armature is attracted toward the magnetic yoke, the armature can engage the surface of the bimetal. The armature window can fill with molten metal from arc splatter. This can result in the armature being tack welded to the bimetal.

There is room for improvement in trip mechanisms.

There is also room for improvement in circuit breakers including a trip mechanism.

SUMMARY

These needs and others are met by embodiments of the disclosed concept in which a magnetic armature has a first side with a surface, an opposite second side, an opening extending from the first side to the opposite second side of the magnetic armature, the opening having a latch surface engaging a latch surface of an operating mechanism when separable contacts are closed or not tripped open. During magnetic interruption of current flowing through the separable contacts, the first side of the magnetic armature engages a bimetal. At least one of the bimetal and the magnetic armature is structured to provide an offset between the bimetal and the surface of the first side of the magnetic armature at the opening of the magnetic armature.

In accordance with one aspect of the disclosed concept, a circuit breaker comprises: separable contacts; an operating mechanism structured to open and close the separable contacts, the operating mechanism comprising a latch surface; and a trip mechanism cooperating with the operating mechanism to trip open the separable contacts, the trip mechanism comprising: a bimetal having a first side and an opposite second side, a magnetic yoke disposed proximate the first side of the bimetal, and a magnetic armature pivotally connected to the bimetal and disposed proximate the opposite second side thereof, the magnetic armature having a first side with a surface, an opposite second side, an opening extending from the first side of the magnetic armature to the opposite second side of the magnetic armature, the opening having a latch surface engaging the latch surface of the operating mechanism when the separable contacts are closed or not tripped open, wherein during magnetic interruption of current flowing through the separable contacts, the first side of the magnetic armature engages the opposite second side of the bimetal, and wherein at least one of the bimetal and the magnetic armature is structured to provide an offset between the bimetal and the surface of the first side of the magnetic armature at the opening of the magnetic armature.

As another aspect of the disclosed concept, a trip mechanism is for an operating mechanism of a circuit breaker, the operating mechanism comprising a latch surface, the trip mechanism comprising: a bimetal having a first side and an opposite second side, a magnetic yoke disposed proximate the first side of the bimetal, and a magnetic armature pivotally connected to the bimetal and disposed proximate the opposite second side thereof, the magnetic armature having a first side with a surface, an opposite second side, an opening extending from the first side of the magnetic armature to the opposite second side of the magnetic armature, the opening having a latch surface structured to engage the latch surface of the operating mechanism, wherein the first side of the magnetic armature is structured to engage the opposite second side of the bimetal, and wherein at least one of the bimetal and the magnetic armature is structured to provide an offset between the bimetal and the surface of the first side of the magnetic armature at the opening of the magnetic armature.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

The disclosed concept is described in association with a single pole circuit breaker, although the disclosed concept is applicable to a wide range of circuit breakers having any number of poles.

Figure 1:
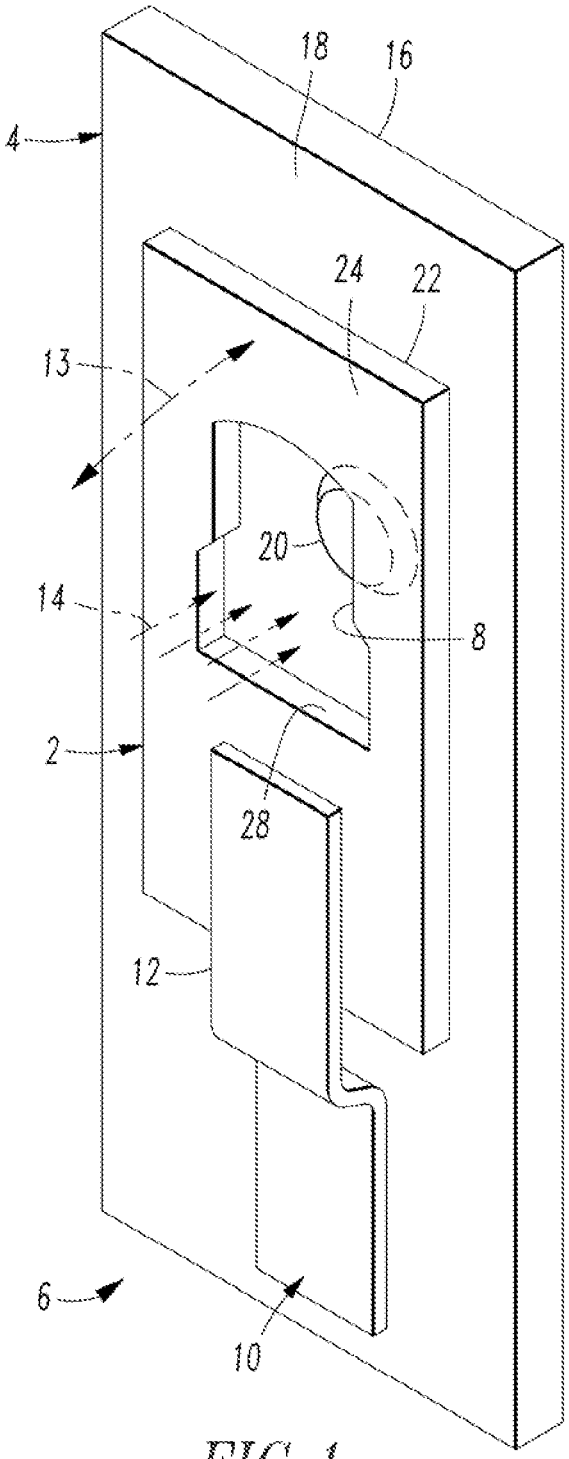
FIG. 1 is an isometric view of an armature and a bimetal in accordance with embodiments of the disclosed concept.
Figure 7:
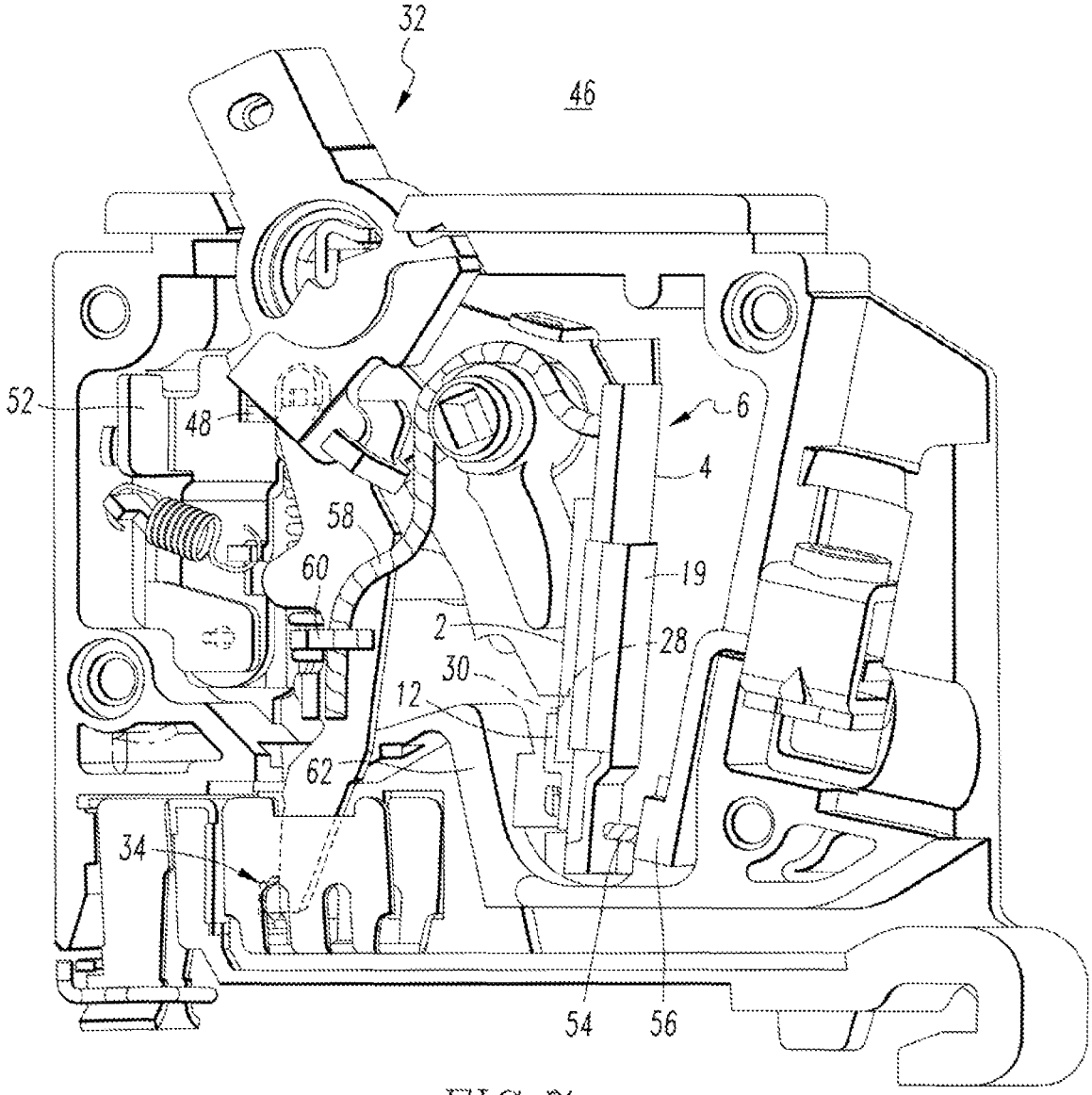
FIG. 7 is an isometric view of a circuit breaker including the armature and the bimetal of FIG. 1.

FIG. 1 shows a magnetic armature 2 and a bimetal 4 of a circuit breaker trip mechanism 6 (also shown in FIG. 7). The armature 2 includes an opening, such as the example armature window 8, an armature pivot point 10, and an armature spring 12. The armature 2 pivots on a pivot path 13 determined by the armature pivot point 10. During a trip operation, arc splatter can enter the armature window 8 in the direction 14.

The bimetal 4 has a first side 16 and an opposite second side 18. A magnetic yoke 19 (shown in FIG. 7) is disposed proximate the bimetal first side 16. The armature 2 is pivotally connected to the bimetal 4 by the armature spring 12 and is normally disposed proximate the bimetal opposite second side 18. The bimetal 4 may include an optional calibration bump 20.

Figure 2:
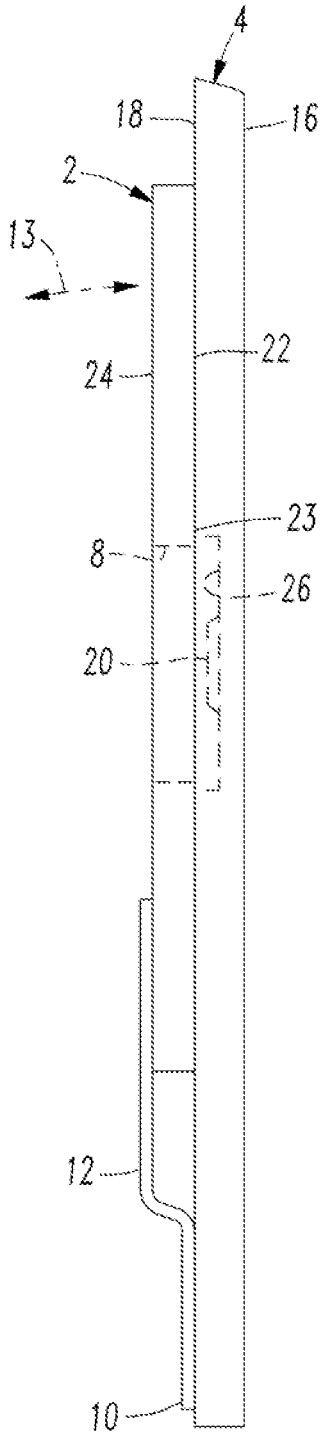
FIG. 2 is a vertical elevation view of the armature and the bimetal of FIG. 1 during a trip operation in which the armature engages the bimetal.

The armature 2 has a first side 22 with a surface 23 (shown in FIG. 2), an opposite second side 24, and the example armature window 8 extending from the first side 22 to the opposite second side 24 of the armature 2. The armature window 8 has a latch surface 28 that engages a latch surface 30 (FIG. 7) of an operating mechanism 32 (FIG. 7) when separable contacts 34 (FIG. 7) are closed or not tripped open. During magnetic interruption of current flowing through the separable contacts 34, the armature first side 22 engages the bimetal opposite second side 18 as shown in FIG. 2. At least one of the bimetal 4 and the armature 2 is structured to provide an offset between the bimetal 4 and the surface 23 of the armature first side 22 at the armature window 8, as will be explained.

As shown in FIG. 2, the bimetal opposite second side 18 includes a depressed pocket 26 facing the armature first side 22 at the armature window 8. During magnetic tripping, the armature 2 can lay flat on the bimetal 4. When there is molten metal (not shown) inside the armature window 8 from arc splatter entering the same in the direction 14 (FIG. 1), the molten metal could otherwise touch the surface of the bimetal 4. The example depressed pocket 26 requires that the molten metal must span a corresponding suitable offset distance provided by the example pocket 26 before the armature 2 could weld itself to the bimetal 4. If not for the example depressed pocket 26, then the armature 2 could tack weld to the bimetal 4 when the arc splatter enters the armature window 8 during interruption.

Figure 3:
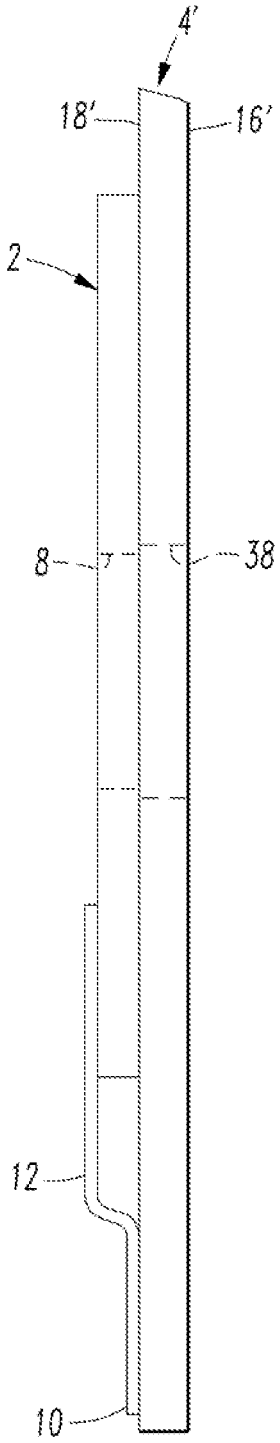
FIG. 3 is a vertical elevation view of an armature and a bimetal in accordance with another embodiment of the disclosed concept.

FIG. 3 shows the armature 2 of FIG. 1 and another bimetal 4', which is somewhat similar to the bimetal 4 of FIGS. 1 and 2. Here, however, instead of the depressed pocket 26 and the optional calibration bump 20 of FIG. 2, the bimetal 4' includes an opening 38 (shown in hidden line drawing) extending from a first side 16' to an opposite second side 18' of the bimetal 4' at the armature window 8. Since there is no calibration bump 20 on the bimetal 4', a bimetal calibration function, which is not part of the disclosed concept, is relocated to a suitable molded feature (not shown) at the bottom (with respect to FIG. 3) of the bimetal 4'. For example and without limitation, there needs to be sufficient room to allow the armature 2 to rotate out of the way and release the cradle 52 (FIG. 7) in order that the circuit breaker 46 (FIG. 7) can trip. The calibration bump 20 (FIG. 2) maintains the proper clearance to allow the armature 2 to move as needed. The bimetal 4' can be located against the suitable molded feature to simulate the calibration bump 20, which acts as a stop for the bimetal to always push against to allow clearance for the armature 2 to release the cradle 52. Otherwise, the armature 2 could be smashed against the bimetal 4' and not have any room to rotate out of the way for the cradle 52 to trip. The suitable molded feature can be a molded block, located at the bottom of the bimetal 4', that acts as a stop for the bimetal 4' to rest against; this allows free rotation of the armature 2 by allowing the cradle 52 to trip free of the armature 2 during tripping.

Figure 4:
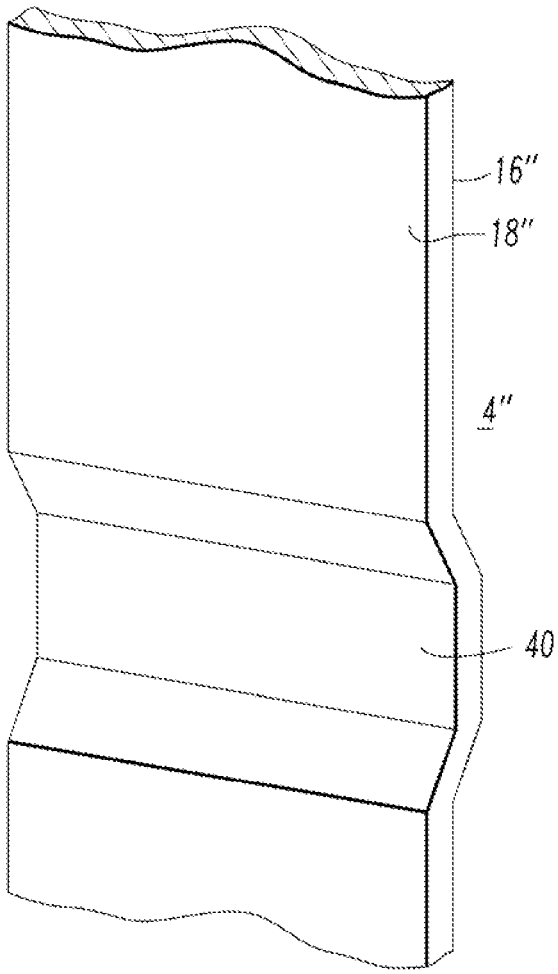
FIG. 4 is an isometric view of a bimetal in accordance with another embodiment of the disclosed concept.

FIG. 4 shows another bimetal 4", which is somewhat similar to the bimetal 4 of FIGS. 1 and 2. Here, however, instead of the depressed pocket 26 and the optional calibration bump 20 of FIG. 2, the bimetal 4" includes a first side 16" and an opposite second side 18", which has a slot 40 facing the armature first side 22 at the armature window 8 (FIG. 1). The example slot 40 across the entire bimetal second side 18" provides a suitable offset to prevent tack welding when arc splatter enters the armature window 8 (FIG. 1) during interruption.

In the examples of FIGS. 2, 3 and 4, the offset is formed by the depressed pocket 26, the opening 38 or the slot 40 of the respective bimetals 4,4',4".

Figure 5:
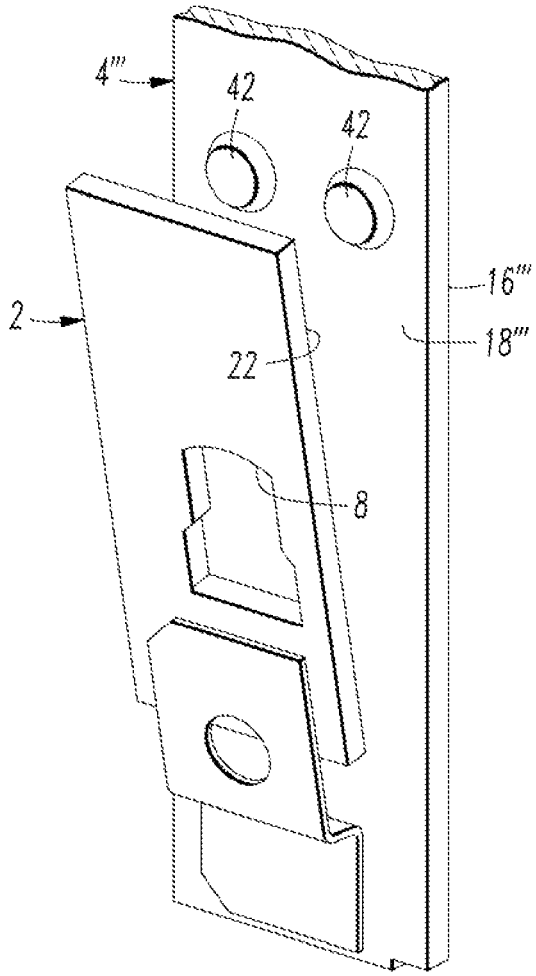
FIGS. 5 and 6 are isometric views of an armature and a bimetal in accordance with other embodiments of the disclosed concept.

FIG. 5 shows the armature 2 of FIG. 1 and another bimetal 4''', which is somewhat similar to the bimetal 4 of FIGS. 1 and 2. Here, however, instead of the depressed pocket 26 and the optional calibration bump 20 of FIG. 2, the bimetal 4''' includes a first side 16''' and an opposite second side 18''' having a plurality of projections, such as the example bumps 42, facing and capable of engaging the armature first side 22, in order to form and provide the offset. The example bumps 42 from the bimetal 4''' provide a suitable offset from the armature 2 to prevent tack welding when arc splatter enters the armature window 8 during interruption.

Figure 6:
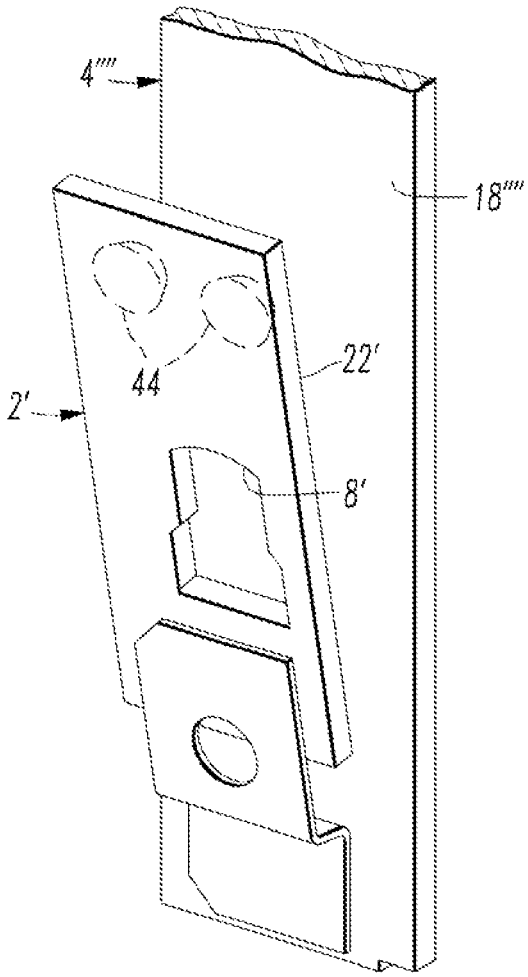

FIG. 6 shows another armature 2' and another bimetal 4'''', which may be similar to the armature 2 and the bimetal 4''' of FIG. 5 except for the example bumps 42. In FIG. 6, the first side 22' of the magnetic armature Y includes a plurality of projections, such as the example bumps 44, facing and engaging the opposite second side 18'''' of the bimetal 4'''', in order to provide the offset. The offset is structured such that the magnetic armature 2' cannot tack weld to the bimetal 4"". The example armature bumps 44 provide the offset from the bimetal 4"" in the area of the armature window 8' to prevent tack welding when arc splatter enters the armature window 8 opening during interruption.

Although bimetal bumps 42 (FIG. 5) and armature bumps 44 (FIG. 6) are disclosed, it will be appreciated that both of the bimetal 4 and the armature 2 can include bumps (not shown) that engage each other to form the disclosed offset.

FIG. 7 shows a circuit breaker 46 including the armature 2 and the bimetal 4 of FIG. 1. The circuit breaker 46 also includes the separable contacts 34, the operating mechanism 32 structured to open and close the separable contacts 34, and the trip mechanism 6 cooperating with a latch surface 30 of the operating mechanism 32 to trip open the separable contacts 34.

The trip mechanism 6 includes the bimetal 4, the armature 2 and the magnetic yoke 19. The bimetal 4 forms a thermal trip device that responds to persistent low level overcurrents, and the armature 2 and the magnetic yoke 19 form a magnetic trip device that responds instantaneously to relatively higher overload currents. The bimetal 4 is coupled at a first (upper with respect to FIG. 7) end to a frame assembly 48. The magnetic yoke 19 is a generally U-shaped member secured to the bimetal 4 at a bight portion of the magnetic yoke 19 with the legs thereof facing the armature 2. The armature 2 is secured to the supporting armature spring 12 that is in turn secured to the bimetal 4. Thus, the armature 2 is supported on the bimetal 4 by the spring 12. The armature window (opening) 8 (FIG. 1) through which the latch surface or ledge 30 on a cradle planar member 52 extends, thereby engaging the edge of the window 8. This acts to latch the cradle 52 of the operating mechanism 32 in closed and non-tripped positions. A first flexible conductor 54 is secured at one end to a second (lower with respect to FIG. 7) end of the bimetal 4 and at the other end to a terminal contact pad 56. A second flexible conductor 58 is secured at one end to the first end of the bimetal 4 and at the other end thereof to an operating arm conductor bracket 60. Thus, an operating arm 62 is electrically coupled with the bimetal 4.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A circuit breaker comprising:

separable contacts;

an operating mechanism structured to open and close said separable contacts, said operating mechanism comprising a latch surface; and a trip mechanism cooperating with said operating mechanism to trip open said separable contacts, said trip mechanism comprising:

a bimetal having a first side and an opposite second side, a magnetic yoke disposed proximate the first side of said bimetal, and a magnetic armature pivotally connected to said bimetal and disposed proximate the opposite second side thereof, said magnetic armature having a first side with a surface, an opposite second side, an opening extending from the first side of said magnetic armature to the opposite second side of said magnetic armature, said opening having a latch surface engaging the latch surface of said operating mechanism when said separable contacts are closed or not tripped open, wherein during magnetic interruption of current flowing through said separable contacts, the first side of said magnetic armature engages the opposite second side of said bimetal, wherein at least one of said bimetal and said magnetic armature is structured to provide an offset between said bimetal and the surface of the first side of said magnetic armature at the opening of said magnetic armature, wherein said bimetal includes an opening extending from the first side of said bimetal to the opposite second side of said bimetal at the opening of said magnetic armature, and wherein said opening of said bimetal is larger than the opening of said magnetic armature.

2. The circuit breaker of claim 1 wherein the opposite second side of said bimetal includes a depressed pocket facing the first side of said magnetic armature at the opening of said magnetic armature.

3. The circuit breaker of claim 1 wherein the opposite second side of said bimetal includes a slot facing the first side of said magnetic armature at the opening of said magnetic armature.

4. The circuit breaker of claim 1 wherein the opposite second side of said bimetal includes a plurality of projections facing and engaging the first side of said magnetic armature, in order to provide said offset.

5. The circuit breaker of claim 1 wherein the first side of said magnetic armature includes a plurality of projections facing and engaging the opposite second side of said bimetal, in order to provide said offset.

6. The circuit breaker of claim 1 wherein said offset is structured such that said magnetic armature cannot tack weld to said bimetal if arc splatter enters the opening of said magnetic armature.

7. The circuit breaker of claim 1 wherein said offset is formed by a depressed pocket, a slot or an opening of said bimetal.

8. The circuit breaker of claim 1 wherein said offset is formed by a plurality of projections from the first side of said magnetic armature.

9. The circuit breaker of claim 1 wherein said offset is formed by a plurality of projections from the opposite second side of said bimetal.

10. A trip mechanism for an operating mechanism of a circuit breaker, said operating mechanism comprising a latch surface, said trip mechanism comprising:

a bimetal having a first side and an opposite second side, a magnetic yoke disposed proximate the first side of said bimetal, and a magnetic armature pivotally connected to said bimetal and disposed proximate the opposite second side thereof, said magnetic armature having a first side with a surface, an opposite second side, an opening extending from the first side of said magnetic armature to the opposite second side of said magnetic armature, said opening having a latch surface structured to engage the latch surface of said operating mechanism, wherein the first side of said magnetic armature is structured to engage the opposite second side of said bimetal, wherein at least one of said bimetal and said magnetic armature is structured to provide an offset between said bimetal and the surface of the first side of said magnetic armature at the opening of said magnetic armature, wherein said bimetal includes an opening extending from the first side of said bimetal to the opposite second side of said bimetal at the opening of said magnetic armature, and wherein said opening of said bimetal is larger than the opening of said magnetic armature.

11. The trip mechanism of claim 10 wherein the opposite second side of said bimetal includes a depressed pocket facing the first side of said magnetic armature at the opening of said magnetic armature.

12. The trip mechanism of claim 10 wherein the opposite second side of said bimetal includes a slot facing the first side of said magnetic armature at the opening of said magnetic armature.

13. The trip mechanism of claim 10 wherein the opposite second side of said bimetal includes a plurality of projections facing and engaging the first side of said magnetic armature, in order to provide said offset.

14. The trip mechanism of claim 10 wherein the first side of said magnetic armature includes a plurality of projections facing and engaging the opposite second side of said bimetal, in order to provide said offset.

15. The trip mechanism of claim 10 wherein said offset is structured such that said magnetic armature cannot tack weld to said bimetal if arc splatter enters the opening of said magnetic armature.

16. The trip mechanism of claim 10 wherein said offset is formed by a depressed pocket, a slot or an opening of said bimetal.

17. The trip mechanism of claim 10 wherein said offset is formed by a plurality of projections from the first side of said magnetic armature.

18. The trip mechanism of claim 10 wherein said offset is formed by a plurality of projections from the opposite second side of said bimetal.

* * * * *